United States Patent [19]

Dahle

[11] 4,288,019

[45] Sep. 8, 1981

[54] PIVOTED STAPLER ASSEMBLIES

[75] Inventor: Gerald Dahle, Coburg, Fed. Rep. of Germany

[73] Assignee: Wilhelm Dahle Buro- und Zeichengerätefabrik, Coburg, Fed. Rep. of Germany

[21] Appl. No.: 128,114

[22] Filed: Mar. 7, 1980

Related U.S. Application Data

[63] Continuation of Ser. No. 969,308, Dec. 13, 1978, abandoned.

[30] Foreign Application Priority Data

Jan. 2, 1978 [DE] Fed. Rep. of Germany ..... 2800042

[51] Int. Cl.[3] ..... B25C 5/02

[52] U.S. Cl. ..... 227/144; 227/124; 227/129; 227/156

[58] Field of Search ..... 227/120, 129, 144, 156, 227/124

[56] References Cited

U.S. PATENT DOCUMENTS

| | | | |
|---|---|---|---|
| D. 147,972 | 11/1947 | Ide | 227/156 X |
| 1,188,510 | 6/1916 | Timson | 227/144 |
| 2,069,601 | 2/1937 | Curtiss | 227/108 |
| 2,089,572 | 8/1937 | Polzer | 227/120 X |
| 2,675,989 | 4/1954 | Vogel | 227/28 |
| 2,859,443 | 11/1958 | Jopp | 227/124 X |
| 3,013,269 | 12/1961 | Brierly | 227/144 |
| 3,368,731 | 2/1968 | La Pointe | 227/124 |
| 4,014,493 | 3/1977 | Wolfe | 227/156 |

FOREIGN PATENT DOCUMENTS

| | | | |
|---|---|---|---|
| 196843 | 9/1957 | Austria | 227/156 |
| 2534178 | 8/1977 | Fed. Rep. of Germany | 227/120 |
| 745834 | 3/1956 | United Kingdom | 227/120 |

*Primary Examiner*—Paul A. Bell
*Attorney, Agent, or Firm*—Spencer & Kaye

[57] ABSTRACT

A stapler assembly frame arranged to be associated with a common office stapler to form a complete assembly, the frame being composed of a pair of two-armed levers pivotally connected at a location between the arms of each lever in the manner of scissors. In the region of their pivot axis one scissors lever is provided with a passage opening through which passes the other scissors lever and the levers provide a fulcrum for each other in the region of the passage opening. The passage opening is dimensioned so that the rear, or pivot, end of the office stapler can be accommodated therein.

31 Claims, 13 Drawing Figures

PIVOTED STAPLER ASSEMBLIES

CROSS REFERENCE TO RELATED APPLICATION

This application is continuation of Applicant's copending United States Application Ser. No. 969,308 filed Dec. 13, 1978 now abandoned.

BACKGROUND OF THE INVENTION

The present invention relates to a stapler assembly of the type composed of two pivotally connected levers and a stapling device releasably fastened to one of the levers and mounted to be pressed against the other lever to effect a stapling operation.

In known stapler assemblies, a supporting foot of the office stapler, or stapling device, is fastened within the lower lever of the stapler assembly and the pivot axis between the upper and lower levers of the stapler assembly lies in front of the staple driver of the stapling device so that both levers are one-armed levers. One such structure is disclosed in Austrian Pat. No. 196,843.

This structure makes the location of a staple difficult to see so that a separate location finding aid is provided. Moreover, this type of structure results in a relatively large distance between the two stapler arms when the stapling device is in its opened position. This impedes ease of manipulation. Finally, to aid operation of such a stapler, a hump must be provided on the surface of the actuating lever of the stapling device, requiring additional expenditures and, when the stapling device is used outside of its lever assembly, this hump is an impediment to operation. Furthermore, filling the stapling device in its assembled state is extremely complicated.

SUMMARY OF THE INVENTION

It is therefore an object of the present invention to provide a stapler assembly of the above-described type in which the above drawbacks are reduced or eliminated and which is easy to manufacture and manipulate.

This and other objects are achieved according to the invention, in a stapler assembly frame arranged to releasably receive an office stapler to form a complete assembly, which frame is composed of two levers pivotally connected together, with the office stapler being releasably fastened to one of the levers and being acted upon by the other one of the levers to effect a stapling operation, by giving each of the levers the form of a two-armed lever the arms of which are disposed to respectively opposite sides of the axis of pivotal movement of the levers relative to one another, and connecting the levers together so that they cross each other in the form of a pair of scissors, providing one of the levers, in the region of the axis of pivotal movement, with a passage opening extending in the plane of pivotal movement of the levers relative to one another, and through which the other lever extends, and dimensioning the passage opening to accommodate the pivot end of the office stapler. Despite the two-armed lever design and the length of conventional office staplers, the novel stapler assembly according to the invention can be made relatively short but with favorable lever ratios.

More specifically, the structural size of the office stapler remains without significant influence on the structural size, and thus the ease of manipulation of the stapler assembly and the freedom of selection of lever ratios of the stapler assembly is not restricted.

In accordance with an advantageous feature of the invention, each of the levers is made in one piece of a plastic, preferably by injection molding, and at least one of the levers includes lateral jaws extending along its longitudinal edges parallel to the plane of pivotal movement of the levers and protruding, at each side of the axis of pivotal movement, in the direction toward that arm of the other lever which is located at the same side of the axis of pivotal movement. This provides a simple and sufficiently stiff design for the scissors lever within which the stapler is disposed in an outwardly encapsulated manner.

According to a further feature of the invention, the lateral jaws extend over the entire length of the lever, and the at least one lever further includes two connecting yokes each forming part of a respective arm of the one lever and each located at the side of its respective arm which is remote from that arm of the other lever which is located at the same side of the axis of pivotal movement. This constitutes a structurally rigid design of the scissors levers, which can be extrusion molded of plastic as one piece, requiring no additional space that would impede operability.

In further accordance with the invention, each lever is provided with such lateral jaws, the lateral jaws of one arm of one lever laterally contact the lateral jaws of one arm of the other lever when the one arms toward one another, and the passage opening is delimited at each side of the plane of pivotal movement only by a respective lateral jaw. This arrangement enhances a neat, cant-free, or twist-free, guidance of the scissors levers along the pivot plane and relieves the pivot axis of stresses in this respect.

According to preferred embodiments of the invention, one of the levers is provided with pivot pins molded in one piece therewith in the area of the passage opening, which pins protrude from the one lever in the direction toward the other lever and perpendicular to the plane of pivotal movement, and the other lever is provided with bearing holes in which the pins engage to establish the pivotal connection between the levers. This permits the elimination of a separate pivot axis, which would otherwise be required. In addition to the conventional office stapler, the stapler assembly according to the invention consequently includes only two further individual parts which can be easily produced in an injection molding step without requiring subsequent working and which can be connected together with ease, particularly when each pin is provided, on its side facing the other lever, with an oblique slide face. The arrangement of the bearing holes in the lateral jaws in the region of the passage opening, due to the resiliency of the jaws in this region, facilitates the sliding together of the two scissors levers for mutual engagement.

Stapler assemblies according to the invention can employ an office stapler provided with a base plate which is firmly seated, as by clamping, between the lateral jaws of one lever arm. This makes possible insertion of the stapler in a simple manner from the front into the stapler assembly into its operating position.

Ths office stapler can further include an operating member pivoted to the base plate at one end of the stapler, and one arm of one lever can be provided with an abutment surface in the region of the other arm of the one lever, with the one end of the stapler resting against the abutment surface. This makes it possible for the stapler to have a length greater than the length of the lever arms associated with the stapler without interfering with the operation of the assembly. Thus it is possible to provide improved stapling conditions, compared to those associated with the office stapler alone, while maintaining handy dimensions for the assembly.

In such a stapler assembly, each of the levers can be provided with such lateral jaws and the lateral jaws of that arm of the other lever which is at the same side of the pivot axis as the one arm of the one lever can enclose the operating member of the office stapler in the manner of a guide. This further reduces the danger of creation of canting, or tilting, pressures that might be exerted on the stapler by the scissors levers.

Stapler assembly frames according to the invention can further be provided with a leaf spring disposed between the levers to urge them in an opening direction and fastened to the inside of one arm of one lever, and detent cams connected to each lever and located to abut against one another during opening movement of the levers for limiting the spreading angle produced between the levers by the pressure of the leaf spring, while permitting further spreading of the levers under additional operating pressure. These components act to spread open the stapler assembly after the stapling process so that the inserted office stapler is returned to its starting position where it is open and ready for the next stapling process. The leaf spring is dimensioned so that it exerts only a supplemental resetting force on the scissors levers in addition to the force exerted by the resetting spring provided in the office stapler itself.

Introduction of fresh staples into the stapler, without removing it from the stapler assembly is made possible by dimensioning the passage opening for permitting the levers to pivot relative to one another to a maximum spreading angle of about 90° between two arms at the same side of the axis of pivotal movement.

When, in an assembly according to the invention, one arm of one lever is arranged to carry the office stapler, that arm, as well as the arm of the other lever which is located at the opposite side of the axis of pivotal movement are each provided with an outer longitudinal surface perpendicular to the plane of pivotal movement, and the other longitudinal surfaces of those two arms are coplanar, and define a supporting surface for the frame, when the levers are in the normal open position, it becomes possible to operate the stapler assembly, in spite of its scissor-like configuration, also in a form where it is supported on a surface, e.g. a desk, without interfering with its operation, which is considered to be an advantage in certain situations.

In a specific preferred embodiment of the invention, the lever provided with the passage opening has the shape of a "Z" in its longitudinal direction and the passage opening is disposed in an approximately vertical region corresponding to the center bar of the "Z". This configuration maintains high stability while enabling the office stapler to extend beyond its pivot axis between the two scissors levers into the region of the operating side of the stapler assembly.

Embodiments of the invention are preferably constructed so that one arm of one lever is arranged to carry the office stapler and the surface of that one arm which supports the stapler forms, with the outer longitudinal surface of that arm, an acute angle which opens toward the other arm of the one lever so as to compensate to some degree for the fact that a stapler assembly is generally held in such a manner that its open end faces somewhat from bottom to top. With such an oblique position, the base plate of the office stapler takes on an approximately horizontal position.

DESCRIPTION OF THE PREFERRED EMBODIMENTS

Figure 2:
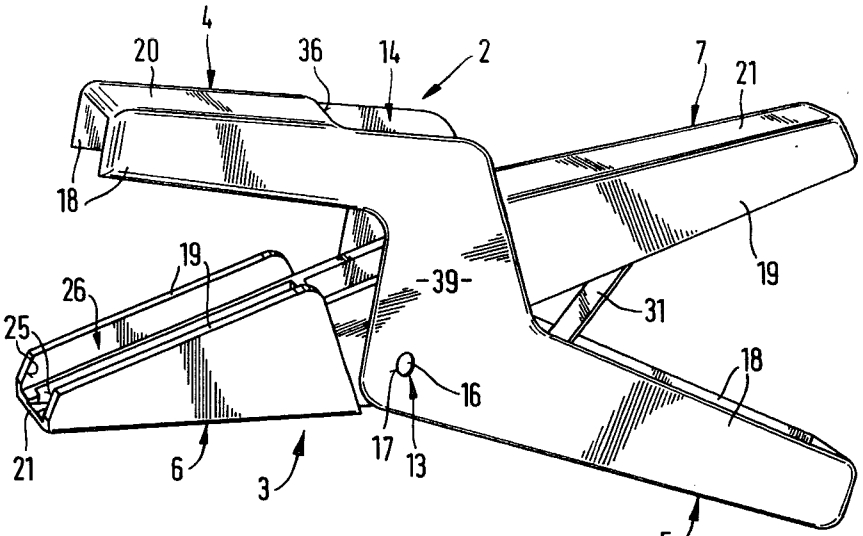
FIG. 2 is a perspective view of a frame presenting two levers intended to be combined with the office stapler of FIG. 1 to form a stapler assembly according to the invention.

The stapler frame shown in FIG. 2 includes two two-armed levers which are pivotal about a pivot axis 1 (FIG. 9) and are connected together in the manner of a pair of scissors in a cross-over arrangement, i.e. is constituted by scissors levers 2 and 3. The front arm 4 of scissors lever 2 forms the upper stapling lever, while the rear arm 5 forms the lower operating lever. The front arm 6 of scissors lever 3 forms the lower stapling lever 6, and the rear arm 7 forms the upper operating lever.

Figure 1:
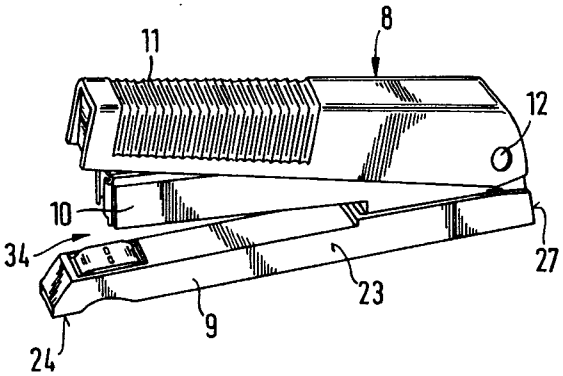
FIG. 1 is a perspective view of a conventional office stapler, or stapling device, which can be incorporated into a stapler assembly according to the invention.
Figure 3:
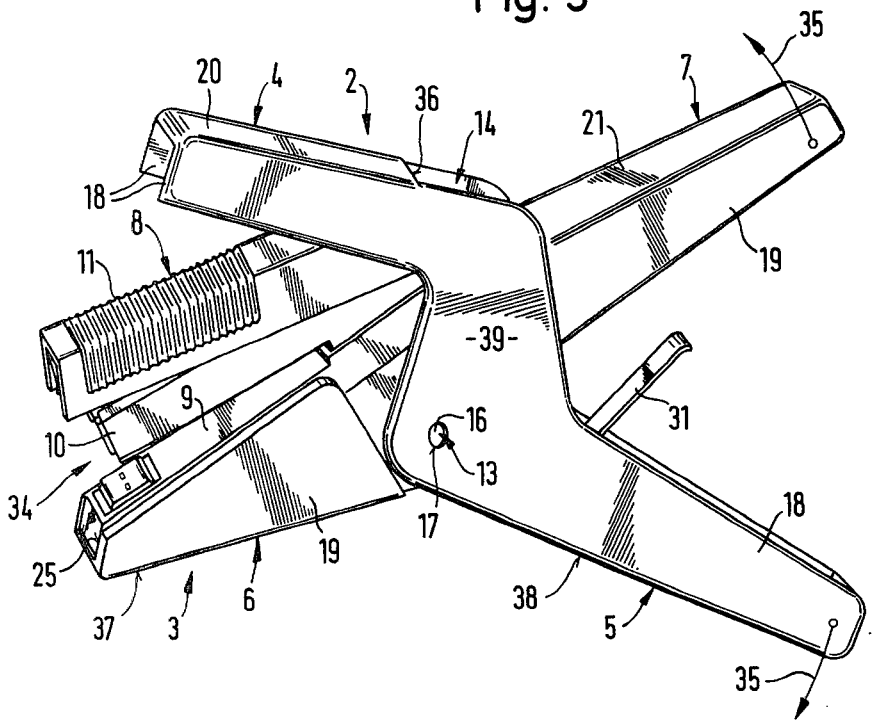
FIG. 3 is a perspective view of a stapler assembly according to the present invention in which the frame of FIG. 2 is equipped with the stapling device of FIG. 1, with the frame in a spread position beyond the normal open position of the two scissors-like levers of the frame.

The actual stapling device is formed by the office stapler 8 shown in FIG. 1. This stapler has a conventional shape, as disclosed, for example, in German Pat. No. 2,534,178. In order to avoid prolixity, only those parts of office stapler 8 which are significant for the present invention are shown here in any detail. These are the base plate 9, the staple magazine 10 and the operating member 11 which is in the form of a lever mounted to be pivotal about axis 12 with respect to the staple magazine 10. Reverting to FIG. 2, scissors lever 3 passes through a passage opening 14 formed in lever 2. The direction of passage through the passage opening 14 lies in the pivot plane 22 of the scissors arms 2 and 3 which plane is depicted in FIG. 6 and is the drawing plane of FIG. 5.

Two pins 16, which have been molded in one piece with scissors lever 3, protrude therefrom in the direction toward the side wall portions 15 of lever 2 defining the passage opening 14 and perpendicular to the pivot plane 22. The pins 16 engage in bearing holes 17 which are disposed in the side walls 15 of the passage opening 14 and penetrate these side walls, as shown most clearly in FIG. 6.

At their two longitudinal edges, the two scissors levers 2 and 3 are provided with respective lateral jaws 18 and 19, the jaws of each lever extending over the entire length thereof parallel to the pivot plane 22 and protruding in the direction toward the other scissors lever.

Connecting yokes 20 extend between lateral jaws 18 and connecting yokes 21 extend between lateral jaws 19. In each lever 2 and 3, the yoke at each side of axis 1 is disposed on the outside of the operating lever 5 or 7, respectively, and of the stapling lever 4 or 6, respectively, facing away from the lever opposite thereto. Thus, with respect to the lateral jaws 18 and 19 which extend over the entire length of the scissors levers 2 and 3, respectively, the positions of the connecting yokes 20 and 21, in the region of the pivot axis 1, change, in that, for scissors lever 2, yoke 20 shifts from the upper side in the area of the upper stapling lever 4 to the underside in the area of the lower operating lever 5, and for lever 3, yoke 21 changes from the underside in the region of the lower stapling lever 6 to the upper side in the region of the upper operating lever 7.

The two scissors levers 2 and 3 contact one another via their lateral jaws 18 and 19, as is shown particularly clearly in FIG. 6. This results in a particularly straight guidance of the relative movement between the scissors levers 2 and 3 in the pivot plane 22.

The passage opening 14 in the region of the pivot axis 1 is defined merely by the lateral jaws 18 which in this region form the side walls 15 of the passage opening 14.

The base plate 9 of the office stapler 8 is seated firmly between the lateral jaws 19 of the lower stapling lever 6. It may also be clamped in there. The lateral walls 23 of the base plate 9 of the office stapler 8 diverge in the direction toward the base surface 24 of the base plate 9, or the base plate has a trapezoidal cross section with its major base at surface 24. In the insertion region of the base plate 9, the inner walls 25 of the lateral jaws 19 of the lower stapling lever 6 are correspondingly inclined and thus form a dovetail guide 26 for walls 23.

In order to provide a seat in the frame shown in FIG. 2, the office stapler 8 is merely pushed in from the front so that base 9 slides into the dovetail guide 26 on the lower stapling lever 6, which guide is disposed between the inner walls 25, until the rear edge 27 of base plate plate 9, disposed in the region of stapler pivot axis 12, abuts against an abutment 28 (FIGS. 5 and 9) on the scissors lever 3, which abutment forms the end of the dovetail guide 26 and is effective on the operating side at a distance from the pivot axis 1. Abutment 28 simultaneously constitutes the beginning of the upper operating lever 7. In this way it is possible to put into the guide 26 an office stapler 8 which is longer than the distance between the forward end of stapling lever 6 and axis 1. Therefore the length of the office stapler 8 is largely independent of said distance.

Figure 12:
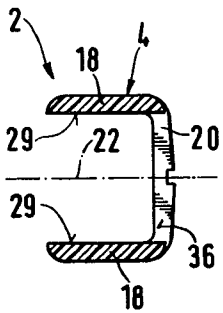
FIG. 12 is a cross-sectional view along the line XII—XII of FIG. 11.

The lateral jaws 18 of the upper stapling lever 4 enclose the operating lever 11 of the office stapler 8 in the manner of a slide guide. For this purpose, the inside surfaces 29 of the lateral jaws 18 of the upper stapling lever 4, shown in FIG. 12, are made parallel to the lateral walls of the operating lever 11 of the office stapler 8. However such a slide guide is not necessary. An appropriate space may also be provided in this region between the lateral jaws 18 and the lateral walls of the upper stapling lever 4.

Figure 5:
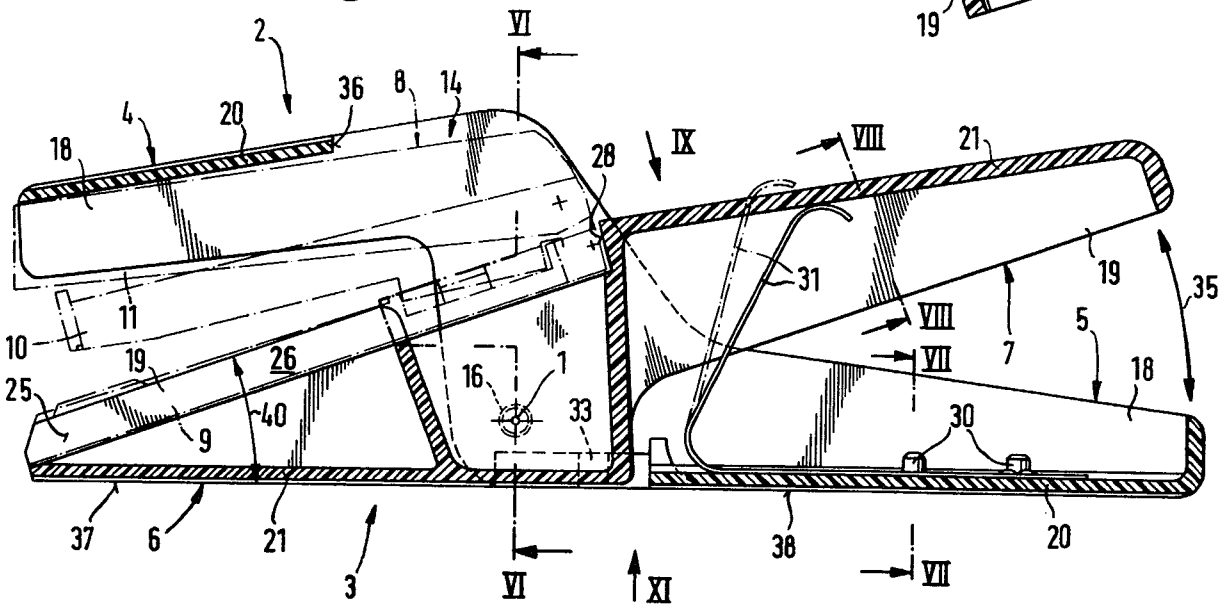
FIG. 5 is a vertical, cross-sectional side view of the stapler assembly of FIG. 4.
Figure 7:
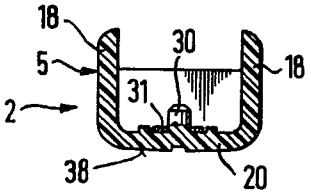
FIG. 7 is a cross-sectional view along the line VII—VII of FIG. 5 through the lower actuating lever.
Figure 6:
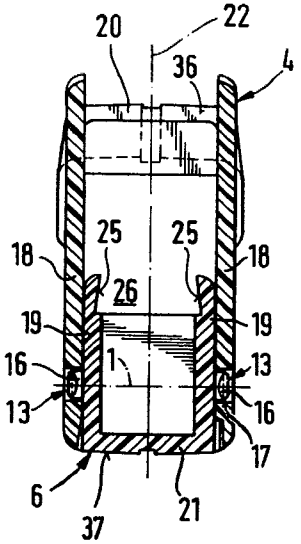
FIG. 6 is a cross-sectional view along the line VI—VI of FIG. 5 through the pivot axis of the stapler assembly.

As is best seen in FIGS. 5 and 7, a leaf spring 31 is fastened to the inside of the connecting yoke 20 of the lower operating lever 5 by means of fastening pins 30.

In its spreading direction, the upper end of the leaf spring 31 acts against the inside of the connecting yoke 21 of the upper operating lever 7.

Figure 4:
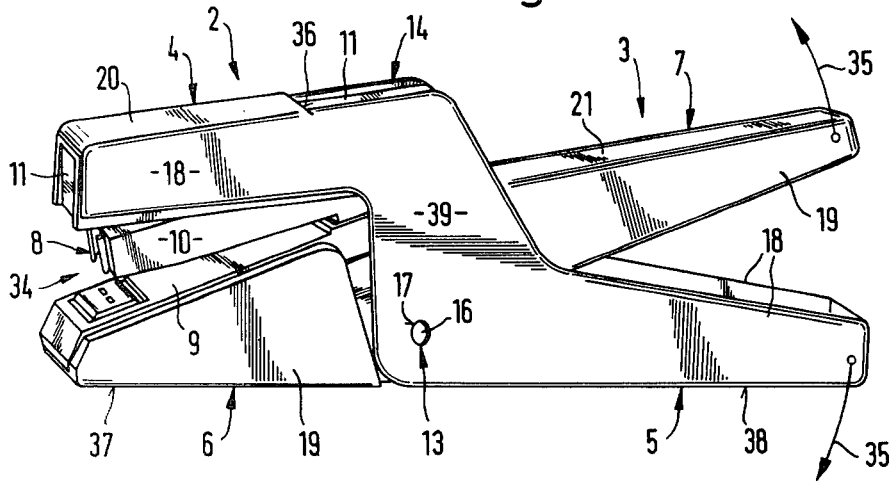
FIG. 4 is a perspective side view of the stapler assembly of FIG. 3 in a position ready for stapling.
Figure 8:
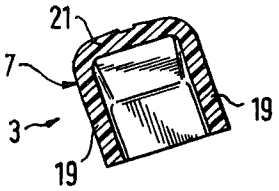
FIG. 8 is a sectional view along the line VIII—VIII of FIG. 5 through the upper actuating lever of the assembly.
Figure 9:
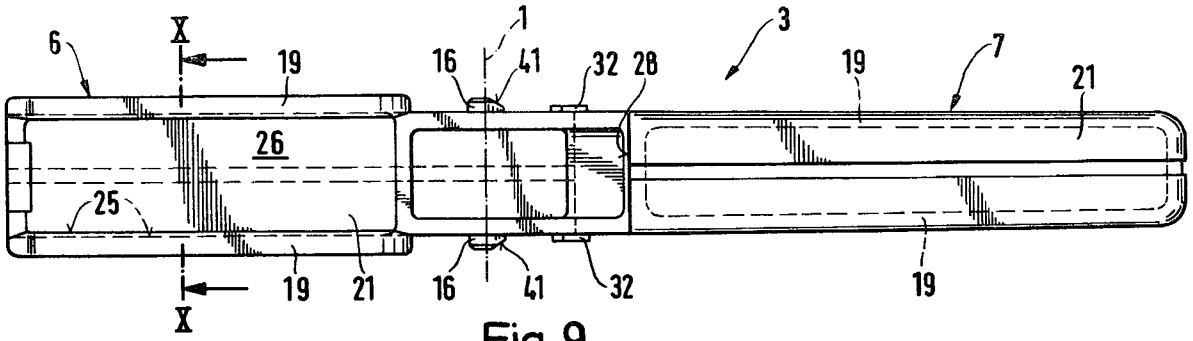
FIG. 9 is a top view in the direction of the arrow IX of FIG. 5 of the scissors-like lever formed by the upper actuating lever and the lower stapling lever of the assembly.
Figure 10:
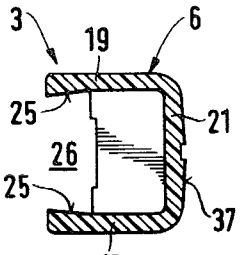
FIG. 10 is a cross-sectional view along the line X—X of FIG. 9.
Figure 11:
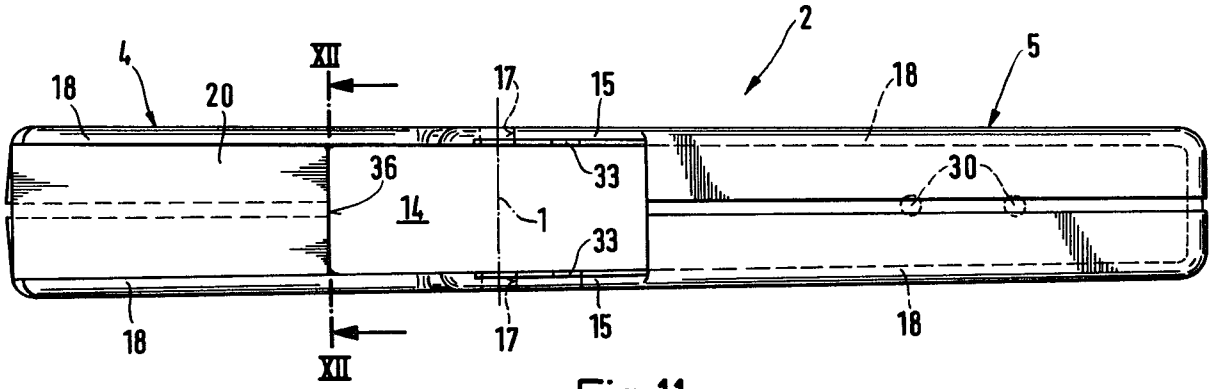
FIG. 11 is a bottom plan view in the direction of the arrow XI of FIG. 5 of the scissors-like lever formed by the upper stapling lever and the lower actuating lever.

Referring to FIG. 9, detent cams 32 protrude outwardly from the lateral jaws 19 of the scissors lever 3 in the vicinity of the pins 16. The cams are oriented approximately parallel to the pins 16. When the scissors lever 3 is pivoted relative to lever 2 about the pivot axis 1, detent cams 32 lie in the pivot path of the detent cams 33 which protrude inwardly from the side walls 15 of the passage opening 14 defined by lever 2. Detent cams 33 are shown in FIGS. 5 and 11. When the operating levers 5 and 7 are spread apart by the leaf spring 31, the spreading path is limited by abutment of the detent cams 32 against the detent cams 33, at which time the office stapler takes on its normal starting position shown in FIGS. 4 and 5, in which the stapling end 34 of the office stapler 8 is ready to receive material to be stapled. The detent cams 32 and 33, however, protrude to only a limited extent so that they can move past one another when additional operating force is applied in the spreading direction 35 on the operating levers 5 and 7. This movement is facilitated by the fact that the detent cams 32 and 33 are each fastened to respective lateral jaws 19 or 18 which permit elastic springing apart of the cams.

Figure 13:
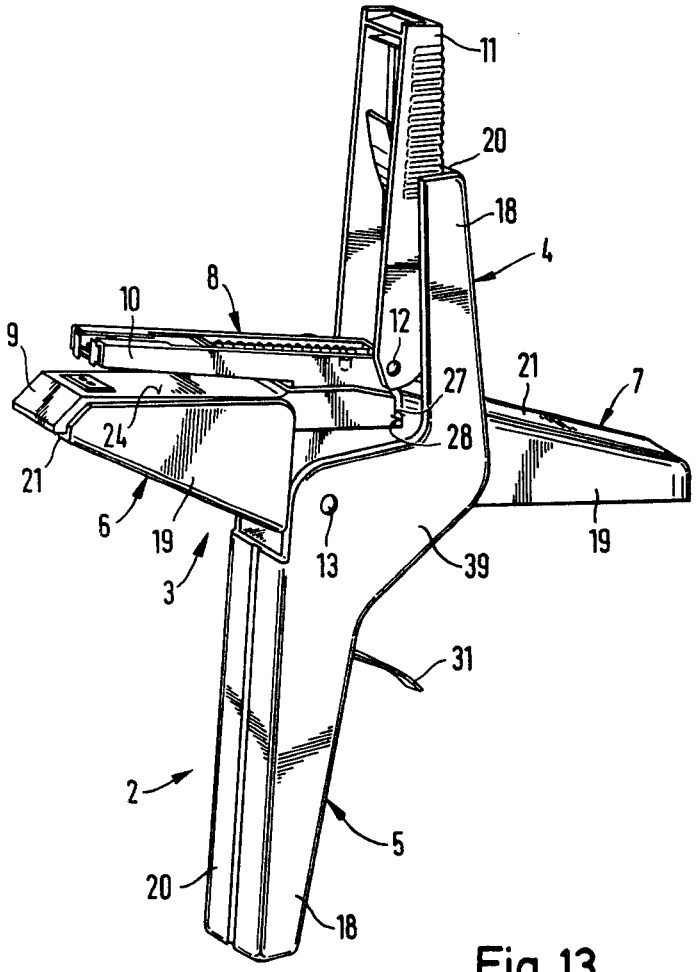
FIG. 13 is a perspective view of the stapler assembly according to the invention in its maximally spread position with the staple magazine of the office stapling device in its open position.

The boundary 36 of the passage opening 14 adjacent the upper stapling lever 4 is so located that a maximum spreading angle of about 90° is possible, in the spreading direction 35, between the two operating levers 5 and 7. This maximum spreading position is shown in FIG. 13. Only in this maximum spreading position does the upper operating lever 7 abut against the boundary 36 of the passage opening 14. This also makes it possible to place the abutment 28 which limits the insertion depth of the office stapler 8 to the side of the pivot axis 1 at which operating levers 5 and 7 are located. Consequently the office stapler 8 may be longer than the effective length of the stapling levers 4 and 6 without thus losing efficiency. This likewise makes it possible to make the stapler assembly short with respect to the length of the office stapler itself without losing any of the favorable lever action.

Reverting to FIGS. 3–7 and 10, the bottom exterior faces 37 and 38 of the lower stapling lever 6 and the lower operating lever 5, respectively, are substantially planar. When the detent cams 32 and 33 are arrestingly engaged, faces 37 and 38 lie in a common plane. Thus they form a firm supporting surface for the stapler assembly which can be operated by merely depressing the upper operating lever 7 or the upper stapling lever 4.

The scissors lever 2 including the lower operating lever 5 and the upper stapling lever 4 has the general form of a "Z" in its longitudinal direction. The passage opening 14 is disposed in the area of the approximately vertical center bar 39 of the "Z". The upper boundary edges of the lateral jaws 19 of the lower stapling lever 6 form, with its bottom face 37, an acute angle 40 which opens toward the operating lever 7, as shown in FIG. 5.

The pins 16 at the scissors lever 3, which forms the lower stapling lever 6 and the upper operating lever 7, are each provided, on their side facing the operating lever 7, with an oblique slide face 41, shown in FIG. 9. The oblique slide faces 41 facilitate insertion of the pins 16 into the bearing holes 17 while simultaneously acting to elastically spread apart the lateral jaws 18 or the walls 15, respectively, of the passage opening 14.

To assemble the frame shown in FIG. 2, it is merely necessary to slide the two scissors levers into one another by advancing lever 3 with its lever arm 7 foremost into opening 14 in such a manner that the pins 16, which have been injection molded to be part of the scissors lever 3 drop into the bearing holes 17 in the scissors lever 2 to form the pivot joint 13. In this position, the pins 16 are held by the elastically returning lateral jaws 18 or side walls 15, respectively, of the passage opening 14. Then, in order to assemble the stapler, the base plate 9 of the office stapler 8 is introduced by a sliding movement, into the dovetail guide 26 of the lower stapling lever 6 disposed between the inner walls 25 of the lateral jaws 19. Inside the dovetail guide 26, the base plate 9 of the office stapler 8 is advanced until its rear edge 27 reaches the abutment 28. The width of the base plate 9 of the office stapler 8 is adapted to coincide with the distance between the inner walls 25 of the dovetail guide 26 so that a friction or clamping lock is produced.

When the stapler assembly is used to staple, the upper stapling lever 4 of the scissors lever 2 presses downwardly on the operating lever 11 of the office stapler 8 in the stapling direction. The surface of the operating lever 11 here slides freely along the inside of the connecting yoke 20 of the upper stapling lever 4. Thus movement of the two operating levers 5 and 7 of the frame toward one another effects the conventional stapling action of the office stapler 8.

To replenish the staple supply, the assembly need only be moved to its maximum spreading position, shown in FIG. 13, whereupon lever 11 can be pivoted up to expose the interior of magazine 10. For fastening of leaf spring 31 during injection molding manufacture of lever 5 spring 31 has on its lower shank two passage holes through which passes the material of yoke 20 in form of the pins 30. Pins 30 therefor are a part of yoke 20 respective the lever 2.

It will be understood that the above description of the present invention is susceptible to various modifications, changes and adaptations, and the same are intended to be comprehended within the meaning and range of equivalents of the appended claims.

What is claimed is:

1. In a stapler assembly including a frame composed of first and second levers pivotably connected together to pivot relative to one another in a pivot plane and about an axis of pivotal pivotal movement, at least a portion of each lever having a U-shaped cross section, and an office stapler which is operable independently of said frame and which is releasably fastened to, and carried by, one of the levers and is arranged to be acted upon by the other lever for movement with respect to an associated pivot axis of said stapler to effect a stapling operation, the improvement wherein:

each of said levers is a two-armed lever the arms of which are disposed to respectively opposite sides of the axis of pivotal movement and said levers cross each other in the form of scissors;

said first lever is provided, in the region of said axis of pivotal movement, with a passage opening and includes a pair of lateral jaws coplanar with the sides of said U-shaped portion of said first lever and laterally delimiting said passage opening; and a portion of said stapler extends into said passage opening.

2. Stapler assembly as defined in claim 1 wherein the pivot end of said stapler extends through said passage opening.

3. Stapler assembly as defined in claim 1 or 2 wherein said stapler includes a base plate defining a bearing surface via which said stapler is supported by said one of said levers, and said bearing surface lies in a plane located between said pivot axis of said stapler and said axis of pivotal movement of said frame.

4. Stapler assembly as defined in claim 1 or 2 wherein each of said levers is made in one piece of a plastic.

5. Stapler assembly as defined in claim 4 wherein each said lever is made by injection molding.

6. Stapler assembly as defined in claim 4 wherein said second lever extends through said passage opening and includes a pair of lateral jaws extending parallel to said pivot plane, traversing said axis of pivotal movement and laterally contacting said lateral jaws of said first lever, said lateral jaws of one of said levers are provided with respective, short pivot pins coaxial with, and defining, said axis of pivotal movement and extending toward said lateral jaws of the other said lever, and said lateral jaws of the other of said levers are provided with respective bearing holes into which said pins snap into engagement when said second lever is pushed through said passage opening.

7. Stapler assembly as defined in claim 6 wherein the end of each said pin is provided, on its side facing the other said lever, with an oblique slide face.

8. Stapler assembly as defined in claim 4 wherein each said lever is molded and further comprising a leaf spring disposed between said levers to urge them in an opening direction and fastened to the inside of one arm of one said lever by being molded thereat during manufacture of said one lever.

9. Stapler assembly as defined in claim 1 wherein said second lever includes a pair of lateral jaws extending parallel to said pivot plane and traversing said axis of pivotal movement, said lateral jaws of each said pair extend over substantially the entire length of their associated lever, and each said lever further comprises two connecting yokes each forming a part of a respective arm of its associated lever and each located at the side of its respective arm which is remote from that arm of the other said lever which is located at the same side of the axis of pivotal movement.

10. Stapler assembly as defined in claim 1 wherein said stapler includes a base plate via which said stapler is supported by said one of said levers, and said one of said levers includes, in the region where said base plate is supported, a pair of lateral jaws firmly holding said base plate.

11. Stapler assembly as defined in claim 1 or 10 wherein said stapler includes a pivotally mounted operating member, and said other lever includes, in the region where it acts upon said stapler, a pair of lateral jaws which enclose said operating member in the manner of a guide which is slidable relative to said operating member.

12. Stapler assembly as defines in claim 1 wherein said second lever includes a pair of lateral jaws extending parallel to said pivot plane and traversing said axis of pivotal movement, and said assembly comprises detent cams mounted on at least one lateral jaw of each said lever and located to abut against one another during an opening movement of said levers for normally limiting the spreading angle between said levers, while permitting further spreading of said levers under additional operating pressure.

13. Stapler assembly as defined in claim 1 wherein said stapler comprises a base plate via which said stapler is fastened to said one lever, an operating member pivoted to said base plate at one end of said stapler and a staple magazine pivoted to said operating member at said one end of said stapler, said operating member being pivotal relative to said magazine to a loading position permitting access to said magazine for insertion of staples, and said passage opening is dimensioned for permitting said levers to pivot relative to one another to an extent permitting movement of said operating member relative to said magazine to said loading position without removal of said stapler from said frame.

14. Stapler assembly as defined in claim 1 comprising detent cams mounted on said levers and located to abut against one another when said levers are in a normal open position, and wherein: one arm of said one lever carries said stapler; said one arm of said one lever and that arm of the other said lever located at the opposite side of the axis of pivotal movement are each provided with an outer longitudinal surface perpendicular of the plane of pivotal movement; and said outer longitudinal surfaces of the two said arms are coplanar, and define a supporting surface for said frame, when said levers are in said normal open position.

15. Stapler assembly as defined in claim 1 wherein said first lever constitutes that lever which acts upon said stapler and has the shape of a "Z" in its longitudinal direction and said passage opening is disposed in an approximately vertical region corresponding to the center bar of the "Z".

16. Stapler assemply as defined in claim 1 wherein said stapler is fastened to one arm of said one lever and said one arm of said one lever has a surface which supports said stapler and an outer longitudinal surface, and said surface which supports said stapler forms with said outer longitudinal surface of said one arm an acute angle which opens toward the other arm of said one lever.

17. In a stapler assembly including a frame composed of first and second levers pivotally connected together to pivot relative to one another in a pivot plane and about an axis of pivotal movement, and an office stapler releasably fastened to one of the levers and arranged to be acted upon by the other lever to effect a stapling operation, each of the levers being a two-armed lever the arms of which are disposed to respectively opposite sides of the axis of pivotal movement and the levers crossing each other in the form of scissors, the first lever being provided, in the region of the axis of pivotal movement, with a passage opening extending along the pivot plane and with a pair of lateral jaws extending parallel to the pivot plane, traversing the axis of pivotal movement and delimiting the lateral sides of the passage opening, and the second lever extending through the passage opening and being provided with a pair of lateral jaws extending parallel to the pivot plane, traversing the axis of pivotal movement and laterally contacting the inner surfaces of the lateral jaws of the first lever, the improvement wherein:

said lateral jaws of one of said levers are provided with respective, short pivot pins coaxial with, and defining, the axis of pivotal movement and extending toward said lateral jaws of the other said lever;

said lateral jaws of said other lever are provided with respective bearing holes into which said pins snap into engagement when said second lever is pushed through said passage opening; and said office stapler is provided with a base plate via which said stapler is releasably fastened to said one of said levers.

18. Stapler assembly as defined in claim 17 wherein the pivot end of said stapler extends through said passage opening.

19. Stapler assembly as defined in claim 17 or 18 wherein each of said levers is made in one piece of a plastic.

20. Stapler assembly as defined in claim 19 wherein each said lever is made by injection molding.

21. Stapler assembly as defined in claim 19 wherein said lateral jaws of each pair extend over the entire length of their associated lever and each said lever further comprises two connecting yokes each forming part of a respective arm of its associated lever and each located at the side of its respective arm which is remote from that arm of the other said lever which is located at the same side of the axis of pivotal movement.

22. Stapler assembly as defined in claim 17 wherein said pivot pins are integral with said lateral jaws of said one of said levers.

23. Stapler assembly as defined in claim 22 wherein the end of each said pin is provided, on its side facing the other said lever, with an oblique slide face.

24. Stapler assembly as defined in claim 23 wherein said base plate of said office stapler is firmly seated at one said arm of one said lever, between said lateral jaws of said one lever, and provided with lateral walls which diverge in the direction toward the lower surface of said base plate, and in the region of said one arm where said base plate is firmly seated, the inner walls of said lateral jaws correspondingly diverge so as to form a dovetail slide guide.

25. Stapler assembly as defined in claim 24 wherein said office stapler further includes an operating member pivoted to said base plate at one end of said stapler, and said one arm of said one lever is provided with an abutment surface in the region of the other arm of said one lever, said one end of said stapler resting against said abutment surface.

26. Stapler assembly as defined in claim 25 wherein each of said levers is provided with said lateral jaws and said lateral jaws of that arm of said other lever which is at the same side of the axis of pivotal movement as said one arm of said one lever enclose said operating member of said office stapler in the manner of a guide which is slidable relative to said operating member.

27. Stapler assembly as defined in claim 17 wherein said stapler further includes an operating member pivoted to said base plate at one end of said stapler and a staple magazine pivoted to said operating member at said one end of said stapler, said operating member being pivotal relative to said magazine to a loading position permitting access to said magazine for insertion of staples, and said passage opening is dimensioned for permitting said levers to pivot relative to one another to an extent permitting movement of said operating member relative to said magazine to said loading position without removal of said stapler from said frame.

28. In a stapler assembly including a frame composed of two levers pivotally connected together, each of the levers being a two-armed lever the arms of which are disposed to respectively opposite sides of the axis of the pivotal movement, of the levers relative to one another, and the levers crossing each other in the form of pair of scissors, one arm of one of the levers being provided with lateral jaws extending along its longitudinal edges and parallel to the plane of pivotal movement of the levers, one of the levers being provided, in the region of the axis of pivotal movement, with a passage opening extending in the plane of pivotal movement of the levers relative to one another; the other of said levers extending through the passage opening, the passage opening being dimensioned to accommodate the pivot end of the office stapler, the assembly further including an office stapler provided with a base plate via which the stapler is firmly seated between the lateral jaws of the one arm of the one of the levers, the improvement wherein: said base plate of said office stapler is provided with lateral walls which diverge in the direction toward the lower surface of said base plate, and in the region of said one arm where said base plate is firmly seated, the inner walls of said lateral jaws correspondingly diverge so as to form a dovetail guide.

29. Stapler assembly as defined in claim 28 wherein said office stapler further includes an operating member pivoted to said base plate at one end of the said stapler, and said one arm of said one lever is provided with an abutment surface in the region of the other arm of said one lever, said one end of said stapler resting against said abutment surface.

30. In a stapler assembly frame arranged to releasably receive an office stapler to form a complete assembly, which frame is composed of two levers pivotally connected together, with the office stapler adapted to be releasably fastened to one of the levers and being acted upon by the other one of the levers to effect a stapling operation, each of the levers being a two-armed lever the arms of which are disposed to respectively opposite sides of the axis of pivotal movement of the levers relative to one another, and the levers crossing each other in the form of scissors, one of the levers being provided, in the region of the axis of pivotal movement, with a passage opening extending in the plane of pivotal movement of the levers relative to one another, the other of the levers extending through the passage opening and the passage opening being dimensioned to accommodate the pivot end of the office stapler, the frame being further composed of a leaf spring disposed between the levers to urge them in an opening direction and fastened to the inside of one arm of one lever, the improvement comprising detent cams connected to each said lever and located to abut against one another during an opening movement of said levers for limiting the spreading angle produced between said levers by the pressure of said leaf spring, while permitting further spreading of said levers under additional operating pressure.

31. In a stapler assembly frame arranged to releasably receive an office stapler to form a complete assembly, which frame is composed of two levers pivotally connected together, with the office stapler adapted to be releasably fastened to one of the levers and being acted upon by the other one of the levers to effect a stapling operation, each of the levers being a two-armed lever the arms of which are disposed to respectively opposite sides of the axis of pivotal movement of the levers relative to one another, and the levers crossing each other in the form of scissors, the one of the levers being provided, in the region of the axis of pivotal movement, with a passage opening extending in the plane of pivotal movement of the levers relative to one another, the other of the levers extending through the passage opening and the passage opening being dimensioned to accomodate the pivot end of the office stapler, the improvement comprising detent cams connected to each said lever and located to abut against one another when said levers are in a normal open position, and wherein: one arm of one said lever is arranged to carry the office stapler; said one arm of said one lever and that arm of the other said lever located at the opposite side of the axis of pivotal movement are each provided with an outer longitudinal surface perpendicular to the plane of pivotal movement; and said outer longitudinal surfaces of the two said arms are coplanar, and define a supporting surface for said frame, when said levers are in said normal open position.

* * * * *